US007201211B2

(12) United States Patent
Kunstreich

(10) Patent No.: US 7,201,211 B2
(45) Date of Patent: Apr. 10, 2007

(54) METHOD AND DEVICE FOR CONTROLLING FLOWS IN A CONTINUOUS INGOT MOLD

(75) Inventor: Siebo Kunstreich, Saint Ouen (FR)

(73) Assignee: Rotelec, Bagnolet (FR)

( * ) Notice: Subject to any disclaimer, the term of this patent is extended or adjusted under 35 U.S.C. 154(b) by 0 days.

(21) Appl. No.: 10/531,283

(22) PCT Filed: Oct. 9, 2003

(86) PCT No.: PCT/FR03/02978

§ 371 (c)(1),
(2), (4) Date: Apr. 14, 2005

(87) PCT Pub. No.: WO2004/035248

PCT Pub. Date: Apr. 29, 2004

(65) Prior Publication Data

US 2006/0005939 A1 Jan. 12, 2006

(30) Foreign Application Priority Data

Oct. 14, 2002 (FR) ..... 02 12706

(51) Int. Cl.
*B22D 27/02* (2006.01)

(52) U.S. Cl. ..... 164/468; 164/452

(58) Field of Classification Search ..... 164/468, 164/502, 503, 504, 452, 154.1
See application file for complete search history.

(56) References Cited

U.S. PATENT DOCUMENTS 4,040,467 A * 8/1977 Alberny et al. ..... 164/468
6,164,365 A * 12/2000 Kunstreich et al. ..... 164/466
6,494,249 B1 * 12/2002 Kollberg et al. ..... 164/452

FOREIGN PATENT DOCUMENTS

EP 0 151 648 A 8/1985
EP 0 550 785 A 7/1993
EP 0 774 313 A 5/1997

* cited by examiner

*Primary Examiner*—Kevin Kerns
*Assistant Examiner*—I.-H. Lin
(74) *Attorney, Agent, or Firm*—Sughrue Mion, PLLC

(57) ABSTRACT

The invention concerns a continuous casting ingot mold equipped with an immersed nozzle (3) provided with lateral outlets (2) opposite the small sides (5) of the ingot mold, and whereof the pattern of molten metal flows can be naturally in single loop or double loop, or even unstable. The invention is characterized in that it consists in using sliding magnetic fields acting, at the nozzle, on the flows of liquid metal reaching the ingot mold through the nozzle orifices, said magnetic fields being generated by polyphase linear electromagnetic field windings (14, 14', 15, 15') arranged opposite at least one side of the ingot mold on either side of the nozzle, preferably opposite one large side and advantageously both, so as to set, or stabilizes, a permanent pattern in double loop mode.

2 Claims, 3 Drawing Sheets

METHOD AND DEVICE FOR CONTROLLING FLOWS IN A CONTINUOUS INGOT MOLD

CROSS REFERENCE TO RELATED PATENT APPLICATIONS

This application claims priority from PCT Application No. PCT/FR03/02978, filed Oct. 9, 2003, based on French Patent Application No. 02-12707, filed Oct. 14, 2002.

BACKGROUND OF THE INVENTION

1. Field of the Invention

The invention relates to the continuous casting of metals, particularly steel, in the form of slabs or of any other similar elongate flat product.

2. Description of Related Art

It relates more precisely to the improvement in the quality of the cast products by controlling the configuration of the convective movements of the cast metal within the mold.

At the present time it has been definitely accepted, without yet being able for the causal link to be explained, that the manner in which the convective movements of the molten metal in the mold are organized is a key factor in determining the quality of the products obtained, both as regards the formation of the very uniform and regular solidification shell around the perimeter of the mold and as regards the surface and sub-shell cleanliness (incrustations of slag, pits, blisters or level of internal cleanliness as regards level inclusions).

What is also known is the importance assumed by the development, as soon as they enter the casting space, of the streams of liquid metal arriving in the mold via the lateral outlet ports of the submerged nozzle that feeds the system with metal to be cast.

Mention may be made in this regard, among others, of the article by P. H. Dauby, M. B. Assar and G. D. Lawson "*Voyage dans une lingotiere de coulde continue. Mesures laser et electromagnetigues de l'hydrodynamigue de l'acier*" [Journey through a continuous casting mold. Laser and electromagnetic measurements of the hydrodynamics of the steel] published in Revue de metallurgie, April 2001, Vol. 4, pages 353–356 and the publication by D. Gotthelf, P Andrzejewski, E. Julius and H. Haubrich "*Mold flow monitoring—a tool to improve caster operation*" at the 3rd European Continuous Casting Conference in Madrid (Spain) in 1998, pages 825–833.

As these documents rightly stress, there are overall three types of liquid steel flow within the mold: the "single roll" configuration and the "double roll" configuration, which are stable modes, and an unstable random-type flow specific to transient regimes in the casting operation.

The latter flow may be described schematically as being an erratic alternation of the "single roll" and "double roll" modes resulting from the momentary and uncontrollable dissymmetries of the flows between the two half casting spaces on either side of the nozzle that are due in particular to perturbations, even minute ones, in the energy at the outlet ports of the nozzle, such as for example, differential variations in the flow rate of antiblocking argon between the two ports.

However, the two aforementioned stable flow modes are themselves more explicit. They are illustrated in FIGS. 1A and 1B appended at the end of this specification. These figures show the stabilized pattern of the paths of the principal currents in a vertical plane passing through the casting axis and parallel to the two long walls of a continuous casting slab mold. The "single roll" mode (FIG. 1A) essentially results, as may be seen, in the fact that the jets of metal 1, as soon as they leave the ports 2 of the nozzle 3 are directed somewhat upward, toward the free surface (or meniscus) 4 of the metal poured into the mold. At this point they travel the width of the half casting space in which each develops by hugging the long walls of the mold until reaching the short end walls 5. It will be recalled, if necessary, that these short mold walls, also called "closure walls" are mounted in line with the end of the long mold walls so as to ensure continuity of the internal periphery of the mold and therefore to seal the casting space. Upon reaching the short mold wall, each jet 1 is then generally reflected downward in the direction of extraction of the cast product, indicated by the bold vertical arrow in the middle of the figure. Of course, the precise mapping of the velocities is much more complex. Many current lines, such as 6, follow paths that are more typically parabolic because of the overall downward extraction movement, but schematically it is indeed this general shape as an upwardly spouting source that is very noticeable when the "single roll" mode is observed in a simulator or in a mock-up.

In contrast, in the "double roll" mode (FIG. 1B), each jet 1, arriving in the mold via the nozzle 3, leaves the ports 2 overall horizontally and thus propagates towards the short mold walls 5, in which everything occurs as if the impact had divided the jet into two currents, a main current 8 reflected downward and a secondary current 7 reflected upward toward the meniscus 4, and at this point the secondary current then travels the half casting space in the opposite direction, this time from the short mold wall 5 toward the nozzle 3. Here again, the actual mapping is much more complex, but it is indeed this overall image in the form of "butterfly wings" that strikes the observer when looking at the screen of a modeler or a mock-up operating in "double roll" mode.

Advances in our understanding and the accumulation of experimental data now make it possible to know, quite well and how, depending on the relevant casting parameters, one or other of the two aforementioned flow modes becomes stable or virtually stable. Without entering into details, which would however be unnecessary and superfluous for comprehension of the invention, it may simply be stated that the larger the width of the slabs cast, and likewise the lower the extraction rate during casting, the more the flow field is in the "single roll" configuration, and vice versa as regards the "double roll" configuration.

It should be pointed out that the operator of the continuous caster does not in general have at his disposal the means to determine the stable flow mode of the metal within his mold. Moreover, it has to be said that very often this is of really no concern to him since, in any case, he would not know how or be able to change the casting aspect ratio or the rate of extraction, which parameters are set by the order book and the material flow within the plant.

However, recent studies by the Applicant have confirmed, if not demonstrated, the existence of explicit causal links between the defects in products resulting from the casting on the one hand (versus the disappearance of these defects) and, on the other hand, the configuration of the convective movements of the liquid metal in the mold. Thus, the origin of the observed quality defects turns out to be due not only to flows of the unstable type, which one might have suspected, but also the stable configuration in "single roll" mode.

BRIEF SUMMARY OF THE INVENTION

The object of the present invention is therefore to offer the continuous slab casting operator a simple and effective tool, attached to his machine without having to reconsider its design, in order to allow him to assuredly establish a "double roll" mode without in any way modifying the adjustment of the casting parameters.

With this objective in mind, the subject of the invention is a method for controlling the configuration of the movements of the liquid metal poured into a continuous casting mold for metal slabs or other similar flat products, especially made of steel, by means of a submerged nozzle provided with lateral outlet ports turned so as to face the short walls of the mold, it being possible for said configuration to be in "single roll" or "double roll" mode, or "unstable", characterized in that traveling magnetic fields are employed that act, in the mold at the height of the nozzle, on the streams of liquid metal arriving in the mold via the ports of the nozzle, said fields being produced by polyphase linear electromagnetic inductors placed so as to face at least one wall of the mold on either side of the nozzle so as to set up, or stabilize, a configuration in "double roll" mode.

According to a preferred method of implementation, magnetic fields are employed that travel horizontally outward, in the direction going from the nozzle toward each short mold wall, by means of inductors placed so as to face at least one long wall of the mold on either side of the nozzle.

According to one method of implementation, the magnetic fields are made to travel throughout the entire casting operation.

According to another method of implementation, the traveling magnetic fields are employed only if the configuration of the movements is not naturally already in "double roll" mode.

Complementarily, if the configuration is already naturally in "double roll" mode, the magnetic fields are made to travel horizontally by means of inductors placed so as to face at least one long wall of the mold on either side of the nozzle, in accordance with the preferred method of implementation described above, but the said inductors are set so that the fields produced by each of them all travel in the same direction so as to impress on the liquid metal in the mold an overall movement of rotation about the casting axis.

The subject of the invention is also an installation for carrying out the method according to said preferred method of implementation, comprising at least one pair of linear traveling-magnetic-field electromagnetic inductors mounted so as to face at least one long wall of the mold and oriented so as to produce a horizontal traveling magnetic field, and a controlled polyphase power supply connected to said inductors in order to produce in each of them a traveling magnetic field directed solely outward, in a direction going from the nozzle toward a short wall of the mold.

As will have doubtless been understood already, the invention makes use of a means that is well known and, if one may say so, that has been commercially available for a long space—the moving magnetic field produced by a polyphase static linear inductor—in order to act dynamically on the liquid metal within the mold so as to establish a "double roll" mode, or to stabilize it if it is already naturally present.

The first applications of magnetohydrodynamics (MHD) to the continuous casting of metals now go back almost thirty years and their success has been unfailing up to now. On the contrary, continuous advances mark its history. The first descriptions related to the stages in the casting machine beneath the mold, particularly the secondary cooling zone because of the absence of a magnetic screen effect that the copper walls of the mold would otherwise oppose. However, thyristor-based polyphase electrical current supplies quickly appeared that allowed them to work at low excitation current frequencies, of below 10 Hz, so that, taking into account the available power levels, the residual screen effect that the copper walls would still oppose no longer represented an obstacle to the application of MHD within the actual mold.

Many and varied in-mold applications have thus been entrusted to MHD, ranging from simple movement of the metal, rotating about the casting axis for example, to its acceleration or braking in the direction of movements that the metal already has naturally, or to imposed changes of direction. Very many published documents (studies, articles, patents) have been dedicated to it. We simply mention here, for simple historical reference, French patent No. 2 187 465 (IRSID) dating from 1972 and already describing a steering action rising along the walls caused by a vertically traveling magnetic field acting on the metal. The aim was thus to favor an equiaxed-type solidification structure right from the mold, and to improve the sub-shell cleanliness via washing of the solidification front by the ascending currents of liquid metal carrying with them the gas bubbles formed in situ and the nonmetallic inclusions up to the meniscus where they are attached to the supernatant cover slag.

We also mention, closer to the present time, and because the application in question is quite close to that of the invention, if not complementary thereto, European Patent Application published under No. 0 550 785 (NKK Corp.). That document in fact proposes the use of inwardly traveling magnetic fields, that is to say traveling from the short mold walls toward the nozzle, in order to brake the jets of liquid metal leaving the ports so as to moderate the vigor of the double-roll movements when the measured velocities at the meniscus are estimated to be too high.

Likewise, European Patent Application published under No. 0 151 648 (KSC) describes the possible choices between vertical stirring of the metal in the mold by means of magnetic fields traveling vertically upward in order to improve the surface cleanliness of the cast product, and horizontal stirring by means of fields that move horizontally in order therefore to improve the sub-shell cleanliness as regards level of inclusions by a washing effect of the solidification front. In this case, it is also advisable to control the various inductors so that the traveling fields, that each individually produces independently of the others, generate an overall effect which is preferably a rotary convective movement of the metal about the axis of the mold. It is also suggested in that document that fields traveling horizontally inward, in the opposite direction to the jets emanating from the nozzle, and therefore from the short walls of the mold toward the nozzle would be conducive to achieving a low level of inclusions depthwise beneath the solidified shell. On the other hand, fields traveling horizontally outward would themselves be favorable, just as were already the rising traveling fields of the aforementioned 1972 French patent, to washing of the solidification front so as to strip it, at the point of action of the field, of the nonmetallic inclusions and CO gas bubbles formed by the solidification of the metal.

It should also be noted that this operating method using magnetic fields traveling horizontally outward and acting at the height of the ports of the nozzle on the incoming jets of metal may be likened to a preferred version of what the invention proposes to do systematically during the entire casting run, but, in this case, to impose a stable "double roll"

mode of circulation of the convective movements of the molten metal within the mold.

BRIEF DESCRIPTION OF THE SEVERAL VIEWS OF THE DRAWINGS

The invention will in any case be fully understood and other aspects and advantages will become more clearly apparent in the light of the discussion that follows, given, by way of example, with reference to the appended plates of drawings, in which.

In the figures, the same elements are denoted by identical numerical references.

DETAILED DESCRIPTION OF THE DRAWINGS

Figure 1A:
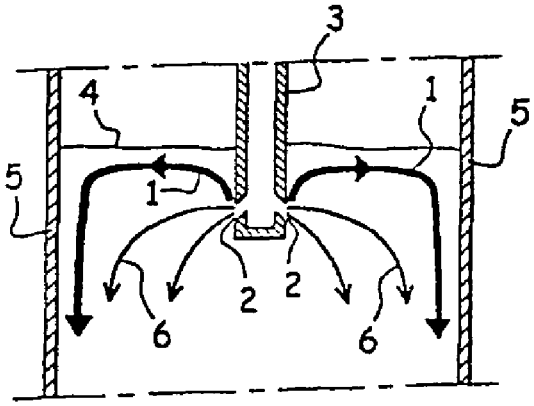
FIGS. 1A and 1B show, as will be recalled, seen from the front and in elevation in axial vertical mid-plane passing through the lateral outlet portions of a submerged nozzle and parallel to the long walls of the mold, the general shape of the paths of the convective currents of liquid metal within the mold, in the case of a "single roll" mode (1A) and in the case of a "double roll" mode (1B), respectively.
Figure 1B:
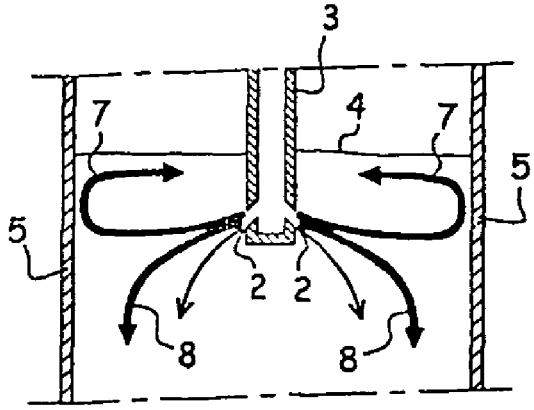

FIGS. 1A and 1B have already been used to illustrate the definitions given in the introductory part of the present specification of what the terms "single roll" and "double roll" mean within the context of the invention.

Figure 2:
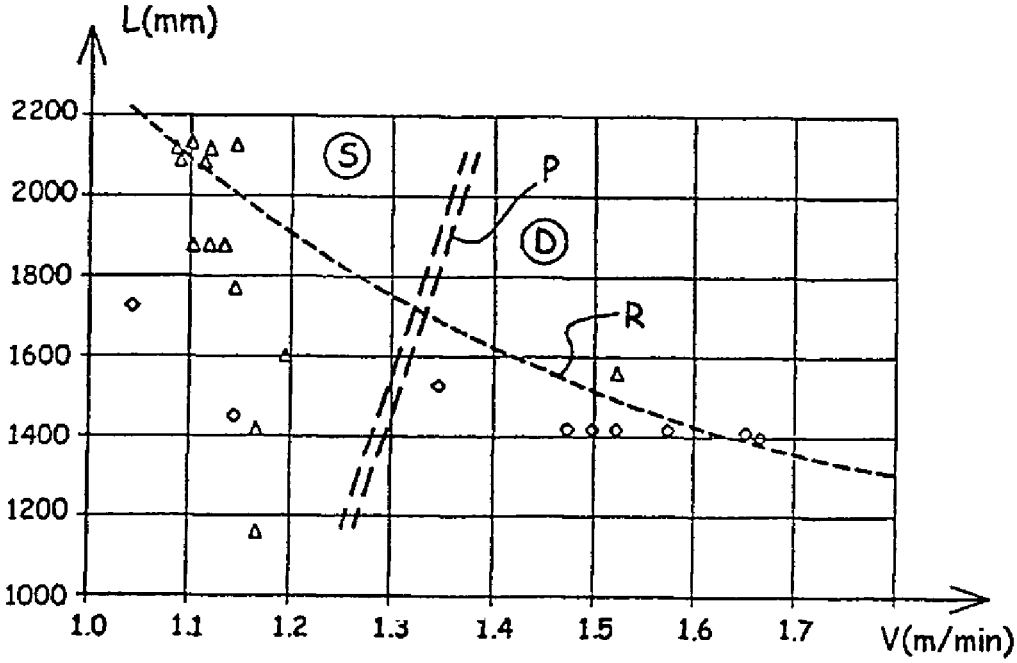
FIG. 2 is a statistical graph established on the basis of a compilation of actual data and making it possible to determine, as a function of the casting parameters, namely the casting rate plotted on the X-axis and the width of the cast slab plotted on the Y-axis, the naturally stable "single roll" field of operation—the field marked S—and the naturally stable "double roll" field of operation—the field marked D. The triangles represent "single roll"-type events while the diamonds represent "double roll"-type events. For the sake of clarity, the data corresponding to the naturally unstable events, which switch randomly from S mode to D mode or from D mode to S mode have not been plotted.

In FIG. 2, to which we now refer, the fields S and D, corresponding to the two types of stable natural recirculation—"single roll" and "double roll"—are separated by a double broken line P at a slight angle to the vertical. This separating line P makes it easy to indicate that the "double roll" natural mode of recirculation of the field D is reserved more for high casting rates, let us say greater than 1.4 m/min, whatever the width of the cast strip, whereas below about 1.2 m/min the recirculation almost systematically lies within the "single roll" field S. Between the two fields, a slight modification of the format of the cast products, in this case by about 1/10th is sufficient to pass from one mode to the other. Likewise, for conventional cast widths, ranging let us say from 1200 to 2100 mm, it is easily possible to switch from "double roll" mode to "single roll" mode simply by the effect of a relatively minor change to the casting rate within the usual 1.2 to 1.4 m/min range. In any case, it may be seen that, at the usual speed of 1.3 m/min, the rivet on the product width is 1500 mm. Below this, the recirculation remains in "double roll" mode while above this, it rapidly switches to "single roll" mode. The dotted line of hyperbolic general shape R represents a reference casting run with a constant metal output of 4.6 metric tons per minute (product between the cast section and the casting rate if it is accepted that the height of the meniscus oscillates little about a fixed value during the casting run).

It will be noted that the separating line P shifts to the left, broadening the "double roll" field when the depth of immersion of the nozzle increases or, if argon bubbling is used to avoid the risks of the nozzle becoming blocked (for example with aluminum-killed low- or very low-carbon heats), when the argon flow rate is lowered.

In summary, it will be understood that the implementation of the invention consists in fact in making the line P disappear by shifting it to the left as far as the point of it being off the diagram.

Figure 3:
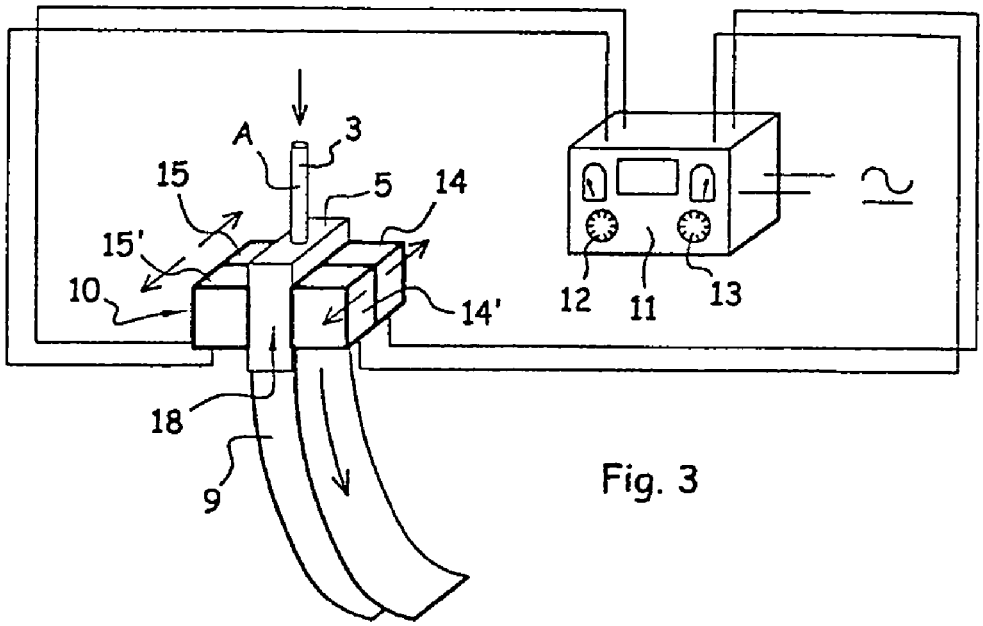
FIG. 3 is a general schematic view of a continuous casting slab mold equipped with the means of the invention.

For this purpose, the implementation means of the invention are those illustrated firstly in FIG. 3. This figure shows a mold 18 for casting steel slabs 9, formed essentially by two pairs of plates, made of copper or copper alloy, that are vigorously cooled by circulating cooling water, one pair of long plates facing each other at a distance that defines the thickness of the slab—these are the long walls of the mold—and a pair of short plates, mounted so as to seal at the end on the right of the long plates in order to ensure continuity of the internal perimeter of the mold that defines the casting space. These plates for the lateral closure of the casting space are the short walls of the mold. As a rule, they are generally mounted so as to move translationally and their position between the long plates, further toward or away from the center, is then a means of adjusting the width of the cast slab.

The mold is fed with fresh metal via a submerged nozzle 3 centered on the casting axis A, the top end of the nozzle being connected in a sealed manner to the opening made in the bottom of a tundish (not shown). As was already seen in FIGS. 1A and 1B, the free bottom end the nozzle is provided with diametrically opposed lateral outlet ports and is immersed in the mold to an adjusted depth (about 40 centimeters or so below the upper edge of the copper plates) with an angular orientation set so that each port is turned toward a short wall 5 of the mold.

The means for implementing the invention are clearly visible in the working position in FIG. 3. They are formed by an electromagnetic unit 10 connected to a polyphase, preferably three-phase power supply 11.

The power supply 11 is based on thyristors so as to be able to vary the frequency of the current by acting on the knob 12 on the front panel. Another knob 13 allows the intensity of the current to be adjusted.

The electromagnetic unit is formed by four, preferably identical, linear inductors of the asynchronous motor flat stator type. For what follows, the reader may refer to FIGS. 3, 4 and 5 together in order to have a more complete understanding of the means employed for carrying out the invention. These inductors are grouped in pairs—one pair of inductors 14, 14' (and 15, 15') per long wall of the mold. The two inductors of the same pair, for example the pair 14, 14' are mounted on the same long mold wall, hut on either side of the nozzle preferably in a symmetrical relative position. These two inductors 14, may be mechanically and electrically independent of each other. However, they are connected to the supply 11 which controls their magnetic operation in a coordinated manner so that each produces a magnetic field that travels horizontally toward the outside of the mold, that is to say in the direction going from the nozzle 3 toward the short end walls 5. The maxima of each field do not need to be, at each instant, located along the inductor at the same distance from the nozzle. It is important only for the constituent electrical windings of each inductor, whether the latter is either of the type "with salient magnetic poles" and are therefore wound, or of the type with "distributed poles", to be themselves polyphase and compatible in this regard with the supply 11 so as for each to be able to be connected to the terminals of this supply in a suitable sequential phase order ensuring that the field travels in the desired "outward" direction.

If necessary it will be recalled that if the magnetic field travels parallel to the mold wall to which the inductor is applied, the field itself, generated by this inductor, is everywhere perpendicular to the plane of this mold wall. In all cases, it is known that it is the component perpendicular co this wall that is the only active component in producing useful energy in the form of a force for driving the metal in the direction of travel of the field. It is therefore advantageous, so as to maximize the energy efficiency of the operation, to have inductors whose lines of force of the fields produced are orthogonal to the plane of the mold walls and that these lines thus propagate as far as possible within the metal to be cast.

This is why, as a general rule, a second pair of inductors is also added, the other long wall of supplies these inductors respect order, such as 15, 15', so as to the mold. The supply 11 added in phase opposition face then with this the facing inductors 14, 14' taken in so that the fields produced by two inductors facing each other on the two opposed walls of the mold, in this case 14 and 15, or 14' and 15', are in the same direction and therefore add together so as, at any point in the space of the gap thus formed, to constitute a magnetic field that passes right through the cast product, and the advantage of which, over a longitudinal field, is known since the intensity at the center of the product is barely less than near the inductors.

Figure 5:
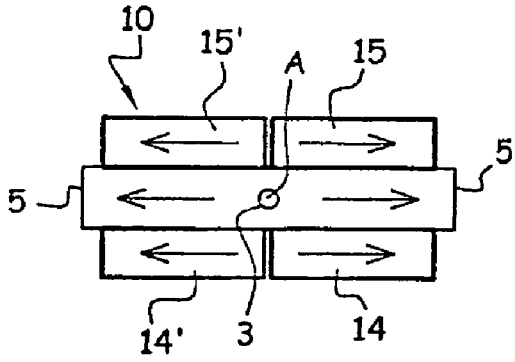
FIG. 5 is a simplified diagram showing, seen from above the mold, the mode of action of the traveling field inductors employed by the invention.

Be that as it may, the diagram in FIG. 5 clearly shows that, according to the invention, when the traveling magnetic fields are used to establish a "double roll" mode, or to stabilize it when it already occurs naturally, the direction of travel is the same for all the inductors acting in the same (left or right) half casting space aid in each half-space the direction of travel goes toward the outside of the mold, that is to say from the nozzle 3 toward the short end walls 5.

Figure 4:
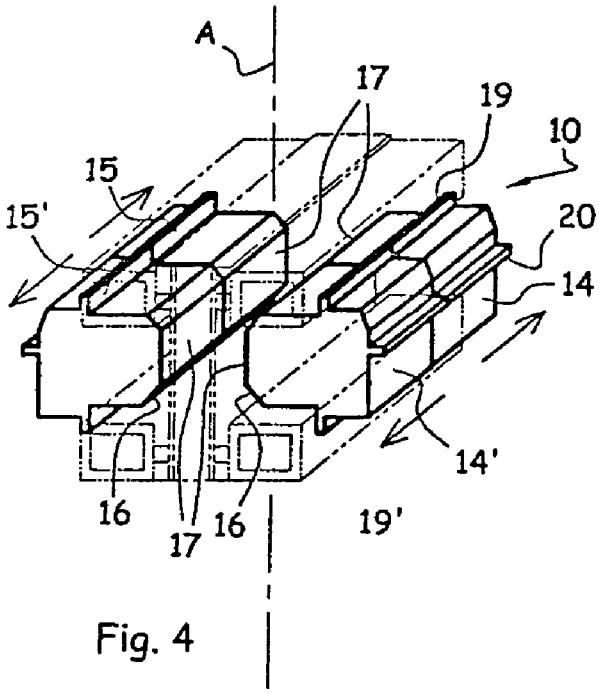
FIG. 4 is a view similar to FIG. 3, but showing in slightly more detail the technology of the traveling-field linear inductors that can be used.

FIG. 4 shows a slightly more detailed view of a technological embodiment of the inductors. They are mounted, as may be seen, in the upper cooling water chamber 16 of the mold (drawn in fine lines) so as to benefit from the cooling effect, but also in order to be able to bring the polar active faces 17 as close as possible to the cast metal. It may also be seen that each inductor has visible ribs 19, 19', 20 intended for the necessary fastenings and mutual alignments and for adjusting their position heightwise by engagement in corresponding support grooves in the carrier frame of the caster (not shown). It will be noted that the active faces 17 are beveled so as to he less exposed, during handling, but also so as to concentrate a little more the lines of force of the magnetic field produced over a shorter distance heightwise.

Figure 6:
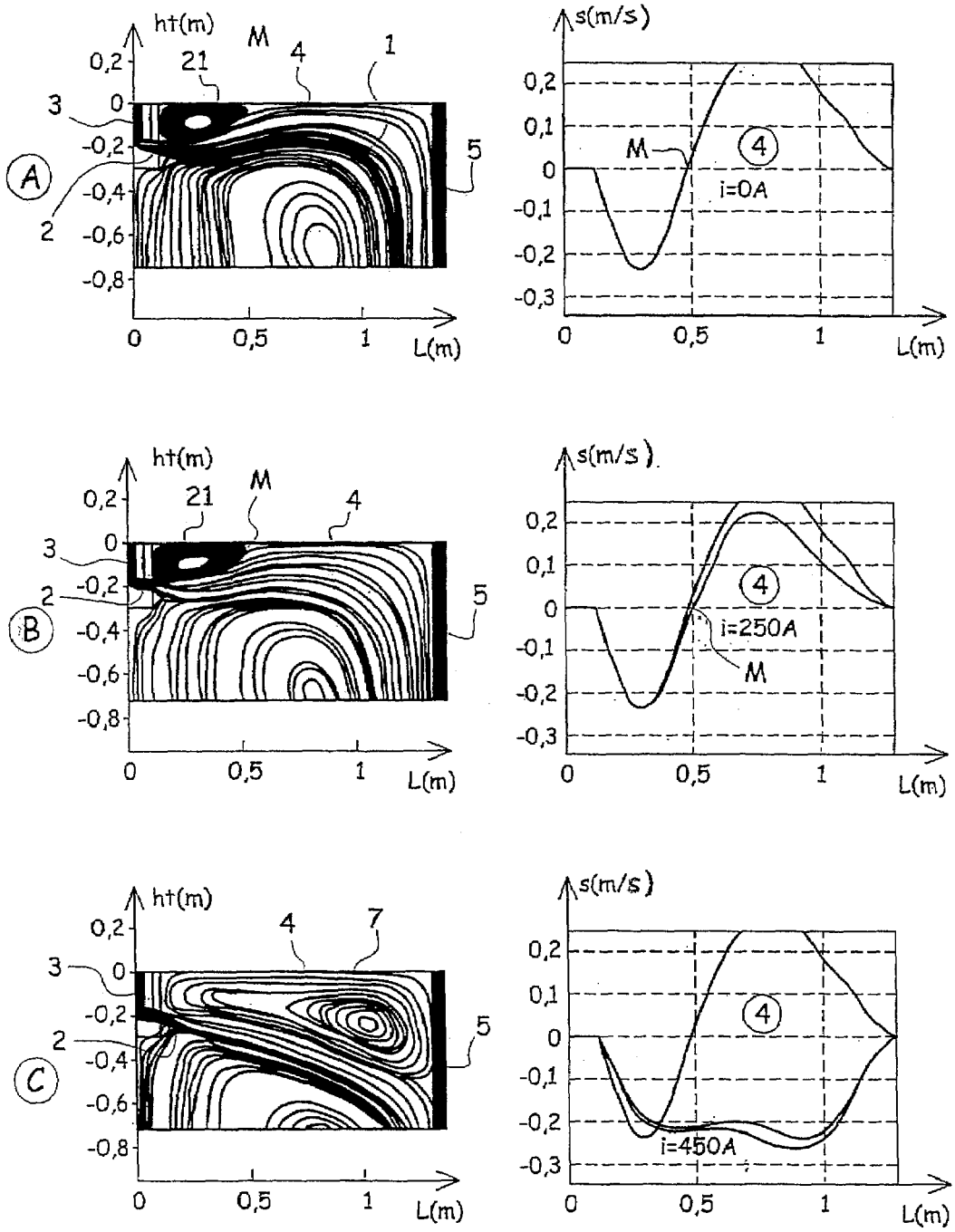
FIG. 6 shows, obtained from a computer simulation by means of a computational model, three pairs of schemes A, B and C placed one above the other and each showing the characteristics of the convective movements within a slab mold with various values of the intensity of the traveling magnetic fields applied according to the invention.

The use of such an electromagnetic installation allows the convective movements of the metal within the mold to be controlled in accordance with the invention and FIG. 6, to which reference will now be made, clearly illustrates the advantage of such control.

Each scheme, A, B or C, shows, in its left-hand window, the paths of the convective current lines of the metal, arbitrarily chosen in the right-hand casting half-space of a slab mold, lying, along the abscissae L between the casting axis A and the short end wall 5 and developing over the height h of the mold from the meniscus 4 (0 ordinate) down to a depth of 70 cm. The associated graph on the right-hand side gives, as ordinates, the corresponding values of the velocity "s" of the metal at the meniscus 4 along the median measurement line that connects the outlet port 2 of the nozzle to the opposed end short mold wall 5 lying along the X-axis. This velocity is taken algebraically, with a positive sign when the direction of the currents goes from the nozzle toward the short mold wall, and therefore with a negative sign in the opposite direction.

All ocher things being equal, each pair is representative of a different value of the intensity of the acting magnetic field. The pair A is associated with a zero field (i=0 A) and therefore illustrates the situation before implementation of the invention. The pair B is associated with a moderate value of the magnetic field intensity, corresponding to an excitation current in the inductive windings of an effective intensity i of 250 A. The pair C illustrates the situation when the app lied magnetic field is produced with a current intensity i of 450 A.

As may be seen in A, the natural state, in the example in question, the configuration is of the "single roll" type. The jet emanating from the port 2 follows a main path −1 plotted in bold lines, which is approximately that shown in FIG. 1A. It will therefore not be described again here. However, the presence in the immediate vicinity of the nozzle of a small roller 21 rotating counterclockwise should be noted. This local phenomenon arises from the fact that the main current 1 readily rises up toward the meniscus after the jet of metal leaves the port 2, lout this rise is not, of course, either immediate or perfectly vertical, so that it inevitably creates counterclockwise local recirculations in the hydraulically "dead" areas against the nozzle. This may also be clearly seen in the associated diagram of the velocities at the meniscus, in which the inversion of the velocities takes place at the point M with the abscissa dimension of 0.5 m from the casting axis corresponding to the end of the roller 21. To the left of this point of inversion M, the metal flows up to the meniscus in the "short mold wall to nozzle" direction, whereas it flows from the nozzle toward the short mold wall to the right of the point M with, moreover, a substantially higher intensity on average. This velocity curve is repeated in the other two diagrams so as to serve as comparison.

When the inductors are activated with an excitation current of 250 amps rms with respect to the 500 amps available as offered by the equipment in question, diagram B shows that nothing significantly different happens compared with the previous situation. However, will be noted, in the velocity diagram, that the Positive velocity peak (the meniscus region to the right of the point of inversion M) bends over slightly, and therefore this point M shifts slightly toward the short mold wall 5, which is in fact expressed by an initiator in favor of establishing the desired "double roll" mode of circulation.

This "double roll" mode is fact fully achieved with an excitation current intensity of the inductors of 450 A rms, as diagram C shows. In fact, the point of inversion has this time completely disappeared, in order to leave a profile of negative values over the entire length of the meniscus. The window on the left shows that this is manifested, apart from the ascending main current line 1 being converted into a continuously descending line 8, by the appearance of an upper recirculation roll 7 that takes a fraction of the fresh jet of metal poured, rising along the short mold wall, from the latter as far as the nozzle 3 and which may be approximately likened to the "double roll" configuration shown in FIG. 1B.

In this example, it may therefore be seen how by implementing the invention it is possible very simply establish a "double roll" mode of circulation on the metal poured into a mold that would naturally be the seat of a "single roll" mode circulation.

The same would apply if the natural situation had been an unstable-type regime. if the original situation had already been in "double lo mode, the invention would have stabilized it. In such a case, there is no fear that the invention would result in excessively vigorous convective movements at the meniscus, movements which it is known are then prejudicial to the desired quality of the cast product obtained. It is because the very principle of the operation of the traveling-field polyphase plane inductors is that of an asynchronous motor: it is the velocity differential between the traveling magnetic field and the current of liquid metal, on which it acts in order to entrain it in its movement, which precisely determines the force of entrainment of the metal. As long as the speed of travel of the field is greater than that of the convection of the metal, there is an effect of metal entrainment by the field. However, this entrainment effect is weaker the closer the circulation velocity of the metal is to that of the displacement of the magnetic field, and the effect becomes in principle zero if these two velocities are equal or become equal.

In short, if the natural mode of circulation of the metal, within the mold is already in "double roll" mode, implementation of the invention will have the advantage of stabilizing it, regularizing it or even moderating it, if required. To do this, all that is required is to adjust the frequency of the excitation current. For a given pole spacing of the inductor, the velocity of travel of the moving magnetic field that it Generates is in fact, as is known, Proportional to the pulse frequency of the field, and therefore to the electrical current flowing through the windings of the inductor that produces said field. As a consequence, the invention makes it possible, if required, to automatically calm too vigorous a -recirculation roll at the meniscus, by choosing the frequency of the excitation current such that the velocity of displacement of the fields is less than that of the metal current at the meniscus.

Put another way, the intensity of the magnetic field is adjusted by choosing the intensity of the excitation current; its speed of travel is adjusted via the frequency of this current; the direction of the travel of the field is adjusted by an "ad hoc" connection of the windings of the inductor to the phases of the power supply. This is nothing other than what a person skilled in the art, using the means, on his caster, already usually knows and has known for a long time. Once more, this again expresses the simplicity and maturity of the tool that the invention makes available to the operator in order to -implement it on an industrial scale.

Having said this, it is quite conceivable, within the context of the invention, to act on the magnetic fields only if the configuration of the convective movements is not already naturally of the "double roll" type. FIG. 2 constitutes, in this regard, a valuable graphical aid that will allow the operator to readily know straight away whether the situation is naturally, or if there is a good chance of it already being, in either a single or double roll configuration.

Likewise, if the configuration is already naturally in a stable "double roll" mode, the operator may very well opt for a particular implementation variable of the invention that consists in using, no longer traveling fields for promoting a "double roll" regime but other traveling fields that themselves move in the same direction on each wall of toe mold, but in opposite directions on the two facing mold walls. Thus, there will be a system of what are called longitudinal moving magnetic fields and no longer traversing magnetic fields, the overall effect of which on the metal will be to induce an overall rotational movement of the metal about the casting axis. To do this, the electromagnetic equipment resins precisely the same. All that is required is simply to modify accordingly the order of connection of the inductive windings of each inductor 14, 14', 15 and 15' at the terminals of the polyphase supply 11. For all that, this method of implementation will also allow, if required, too vigorous a recirculation roll at the meniscus to be automatically calmed, by again choosing a frequency of the excitation current such that the speed of displacement of the fields is less than that of the current of metal at the meniscus.

It goes without saying that the invention is not limited to the examples explained the present specification, but extends to many variants or equivalents provides that its definition given by the appended claims is respected.

For example, it is possible to promote the "double roll" mode with traveling magnetic fields that act no longer on the long walls or walls of the mold but on the short end molds walls. The inductor to be used to create each acting field may be the same as previously.

However, it will have to be placed on the short mold wall at a level heightwise corresponding grosso modo to the range separating the meniscus from the horizontal projection on the short mold wall of the port of the facing open nozzle, and will be oriented differently so as to produce a vertical traveling field. Moreover, its windings will have to be connected to the phases of the power supply so as to ensure that the field moves upward.

The invention claimed is:

1. A method for controlling the configuration of movements of a liquid metal poured into a continuous casting mold for metal slabs or other similar flat products by setting a double roll mode in the continuous casting mold, the method comprising:

providing a nozzle with lateral outlet ports submerged in the continuous casting mold and that face short walls of the continuous casting mold;

supplying the liquid metal to the continuous casting mold though the lateral outlet ports;

employing a linear inductor source to generate a traveling magnetic field having a magnetic flux perpendicular to a long wall of the continuous casting mold at a level substantially the same as the lateral outlet ports of the submerged nozzle, a portion of the linear inductor source generating the magnetic field traveling horizontally in a direction going from the nozzle toward each short mold wall, in order to set permanently said double roll mode in the continuous casting mold.

2. The method as claimed in claim 1, wherein the magnetic field is employed only if the configuration of the movements of the metal poured into the mold is not naturally in a double roll mode.

* * * * *